United States Patent [19]

Lee et al.

[11] 4,386,498

[45] Jun. 7, 1983

[54] METHOD AND APPARATUS FOR PREVENTING THE DEPOSITION OF CORROSIVE SALTS ON ROTOR BLADES OF STEAM TURBINES

[75] Inventors: Pang-Kai Lee, Murrysville; William M. Hickam, Churchill, both of Pa.; William G. Steltz, Cherry Hill, N.J.

[73] Assignee: Westinghouse Electric Corp., Pittsburgh, Pa.

[21] Appl. No.: 197,378

[22] Filed: Oct. 15, 1980

[51] Int. Cl.[3] ..... F01K 13/02

[52] U.S. Cl. ..... 60/646; 60/657; 60/660; 60/667; 415/118

[58] Field of Search ..... 60/646, 657, 660, 664, 60/663; 415/118

[56] References Cited

U.S. PATENT DOCUMENTS 2,595,490 5/1952 Schubring ..... 60/657
3,370,542 2/1968 Harney ..... 415/118

FOREIGN PATENT DOCUMENTS 52-19804 2/1977 Japan ..... 60/646

*Primary Examiner*—Allen M. Ostrager
*Attorney, Agent, or Firm*—D. Schron

[57] ABSTRACT

A turbine system which includes a reheater upstream from a low pressure turbine which is subject to corrosive salt depositions from the steam. Conductance probes are inserted at predetermined positions within the low pressure turbine and based on the conductance signals the reheat temperature or load is varied so as to move the corrosive salt deposition zone away from a rotating blade stage of the low pressure turbine.

15 Claims, 14 Drawing Figures

METHOD AND APPARATUS FOR PREVENTING THE DEPOSITION OF CORROSIVE SALTS ON ROTOR BLADES OF STEAM TURBINES

CROSS-REFERENCE TO RELATED APPLICATIONS

This application is related to application Ser. No. 197,317, filed Oct. 15, 1980 and assigned to the same assignee as the present invention.

BACKGROUND OF THE INVENTION

1. Field of the Invention

The invention in general relates to steam turbine systems and in particular to a system for regulating certain corrosive depositions within the turbine system.

2. Description of the Prior Art

In a typical steam turbine system, water is transformed to superheated steam by means of a steam generator and provided to a plurality of turbine sections ranging from a high pressure section to a low pressure section. As the steam passes through the turbines, pressure and temperature changes take place such that near the exit of the low pressure turbine, the steam undergoes an expansion whereby a consequent transition to a wet condition results.

The wet steam exiting from the low pressure stage is provided to a condensor for eventual return to the steam generator. Prior to its introduction back to the steam generator, the water undergoes chemical treatment in an attempt to eliminate various impurities. Even with this water treatment, the steam passing through the turbine sections may contain impurities resulting from chemicals utilized in the water treatment, or a faulty condenser, by way of example. Although these impurities may exist at levels as slight as parts per million down to parts per billion, the deposition of these impurities on rotating steam turbine blades may lead to pitting, corrosion fatigue and stress corrosion cracking. The most common corrosive precipitates are various salts such as sodium chloride, sodium sulfate, sodium phosphate, as well as other corrosive materials such as sodium hydroxide. The present invention describes a system for reducing or eliminating the corrosive effects of corrosive salt deposition on rotating turbine blades.

SUMMARY OF THE INVENTION

In the present invention one or more conductivity cells are inserted in the steam flow path within a low pressure turbine. The low pressure turbine is part of a turbine-generator system which includes a steam generating unit, a plurality of turbine sections such as a high pressure turbine, a low pressure turbine and for some designs, an intermediate pressure turbine. A reheater is disposed in the steam path prior to the low pressure turbine.

During the steam expansion in the blade stages of the low pressure turbine, entrained salts precipitate out in a relatively narrow salt solution zone within the turbine. The concentration of salts within this zone can cause serious stress corrosion and cracking problems if deposited on a rotating blade. In the present invention, the inserted conductivity cell or cells provide an indication of the zone and corrective measures are taken by varying the reheat temperature and/or the initial pressure of the steam entering the turbine, to move the zone away from the rotating blade. By cycling the reheat temperature the blades may be washed free of the corrosive salt deposits.

Conductivity cells may additionally be placed at other locations in the turbine system to provide indications of the presence of other corrosives which are not localized in the low pressure turbine, such as sodium hydroxide by way of example.

DESCRIPTION OF THE PREFERRED EMBODIMENT

Figure 1:
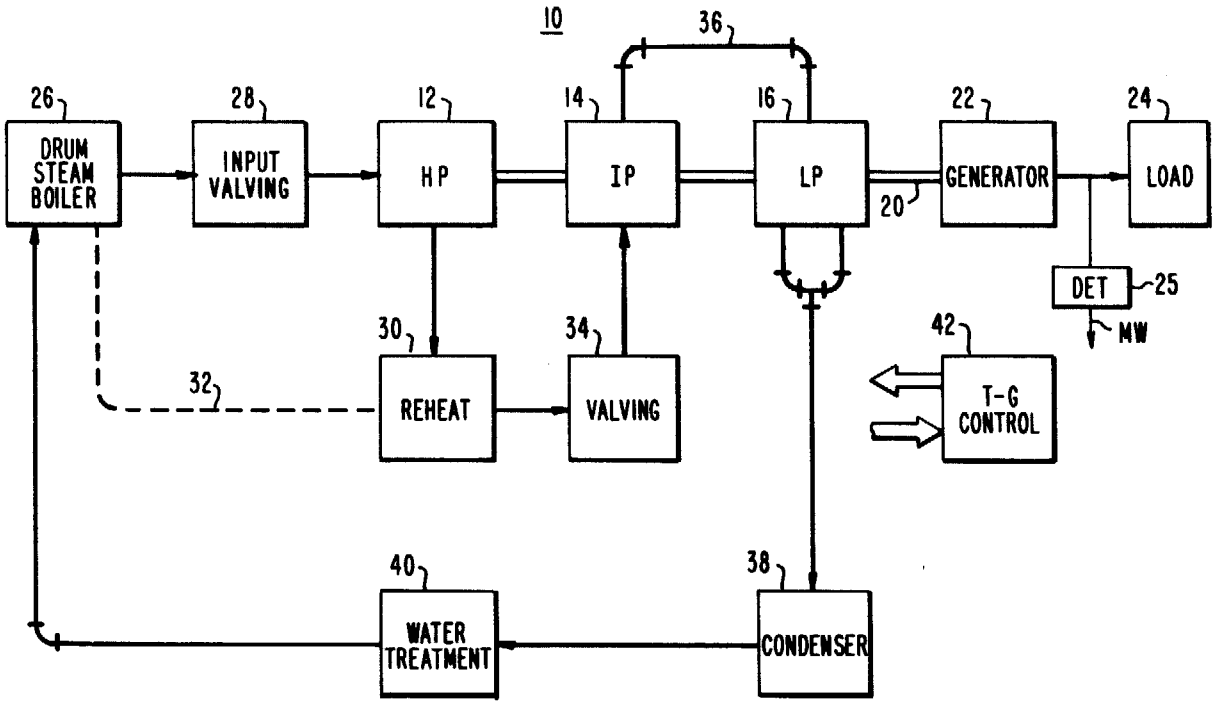
FIG. 1 is a block diagram illustrating a typical steam turbine system.

Although the invention is applicable to a variety of steam turbine systems it will be described by way of example with respect to a fossil fired, tandem-compound single reheat turbine-generator unit as illustrated in FIG. 1. The turbine system 10 includes a plurality of turbines in the form of high pressure (HP) turbine 12, intermediate pressure (IP) turbine 14 and low pressure (LP) turbine 16 all of which are coupled to a common shaft 20 to drive an electrical generator 22 which supplies power to a load 24. A detector 25 coupled to the generator output provides a megawatt signal (MW) indicative of load.

A steam generating system 26 such as a conventional drum type boiler operated by fossil fuel generates the steam which is provided to turbine system 10 through input governor and throttle valving arrangement 28. Steam exiting the HP turbine 12 is reheated in a reheating unit 30 which may for example include parallel connected reheaters coupled to the drum boiler 26 in heat transfer relation, as indicated by reference character 32. Steam from the reheater system is supplied to the IP turbine 14 through valving arrangement 34. Steam from the IP turbine 14 in turn is provided by way of crossover piping 36 to the LP turbine 16 from which the steam is exhausted into a conventional condenser 38. Water from condenser 38 may be filtered and chemically treated in water treatment system 40 and thereafter returned to the steam generating system.

A turbine-generator control system 42, which may include one or more control computers, is responsive to various parameters measured throughout the turbine-generator system to provide control signals for the optimum operation of the system, such control signals for example being provided to the valving arrangements, and steam generating system.

Figure 2:
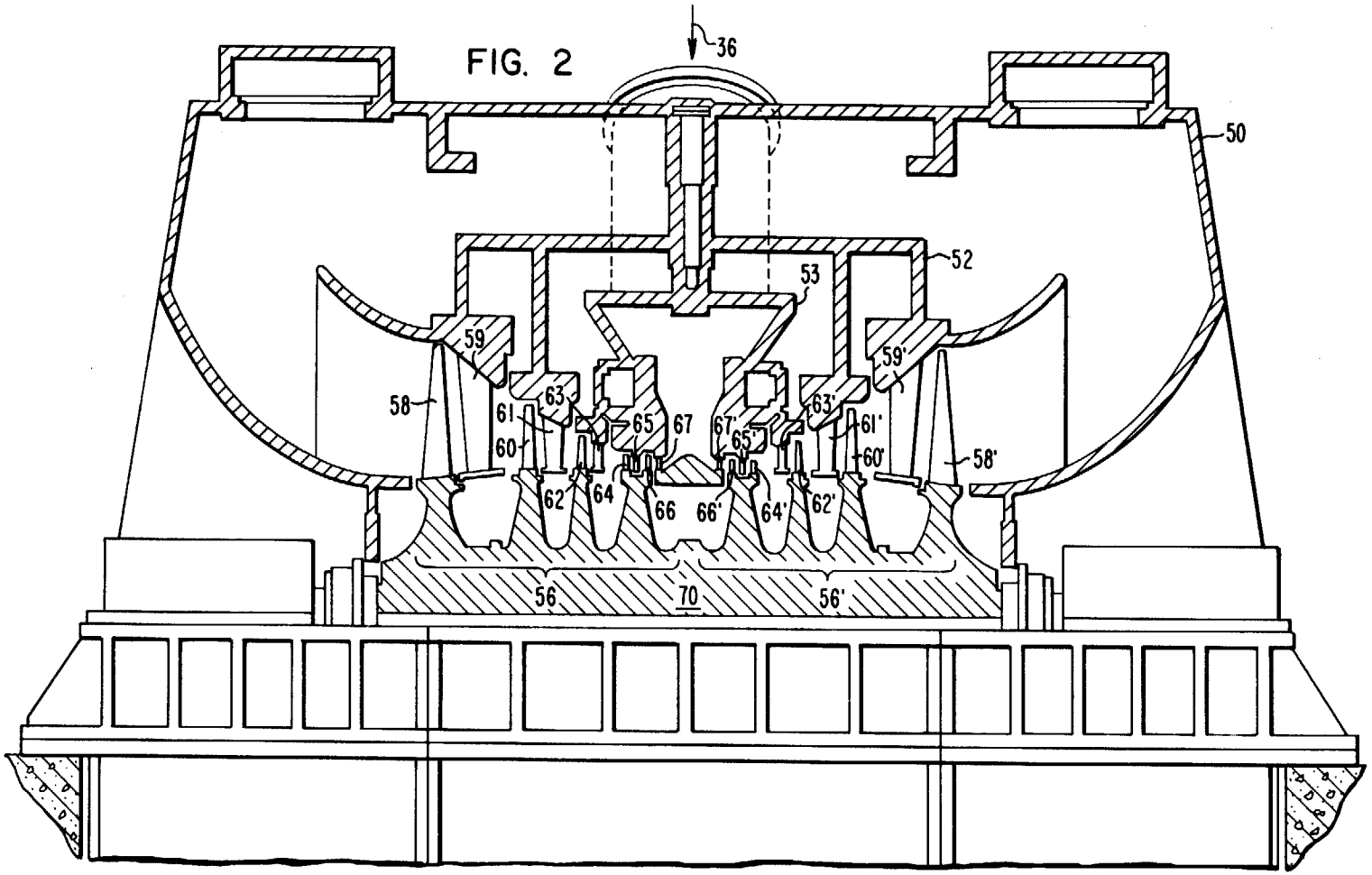
FIG. 2 is a cross-section through a typical low pressure stage of a steam turbine.

FIG. 2 is a partial cross-section of the LP turbine 16. Turbine 16 is a double-flow design which includes an outer cylinder 50 and first and second inner cylinders 52 and 53. Steam enters the double-flow design through crossover piping 36 and steam expansion simultaneously takes place through turbine blade stages 56 and 56'. Blades 58, 60, 62, 64 and 66 (and their primed counterparts) are connected to rotor 70 and constitute rotor blades, whereas blades 59, 61, 63, 65 and 67 (and their primed counterparts) are stationary blades connected to an inner cylinder.

Blades 58 and 59 constitute the last stage while blades 60 and 61 constitute the next to the last stage. In turbine terminology blades 58 and 59 constitute the last stage and accordingly blades 60 and 61 are the last stage minus one stage, or the "L-1" stage. Similarly, blades 62 and 63 constitute the L-2 stage, blades 64 and 65 the L-3 stage, etc. Rotor blade 58 is designated L-0R, blade 60 is the L-1R blade, blade 62 the L-2R blade, etc. Cylinder blade 59 is designated L-0C, blade 61 is the L-1C blade, blade 63 is L-2C, etc.

In a typical operation, superheated dry steam enters the first stage and passes through subsequent stages where expansion and temperature and pressure changes take place. At approximately the L-1 stage there is a moisture transition zone where the dry steam converts to a moist fog-like condition.

Figure 3A:
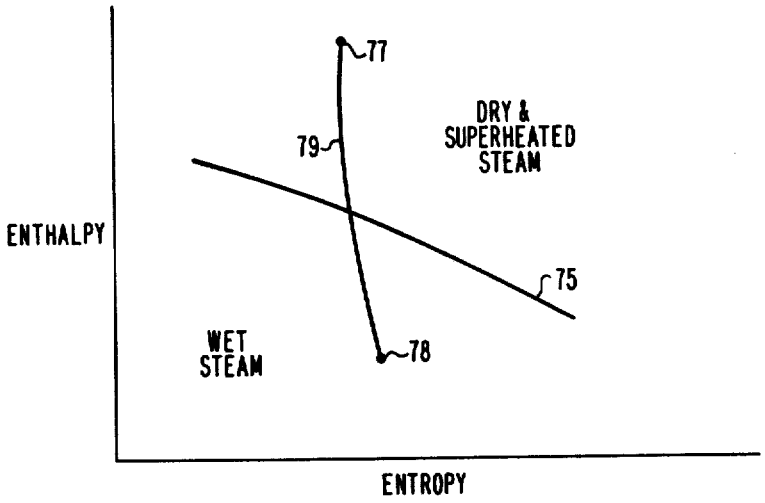
FIGS. 3A–3E are plots of enthalpy versus entropy for steam and steam-water mixtures to aid in understanding of the present invention.

In steam calculations use is made of a Mollier diagram or chart which is a plot of enthalpy versus entropy. Enthalpy is an indication of total heat content and is measured in terms of BTU per pound mass whereas entropy is an indication of the quotient of heat energy divided by product of mass and temperature measured in BTU per pound mass per degree of absolute temperature. FIG. 3A illustrates a portion of a Mollier diagram which includes a saturation line 75 above which steam is dry and in a superheated state, and below which is the region of wet steam or mixture of steam and water. By way of example dry steam at certain conditions defined by point 77 will expand through the IP and LP turbines so as to exit with conditions defined by point 78, the expansion taking place along the steam expansion line 79.

Figure 3B:
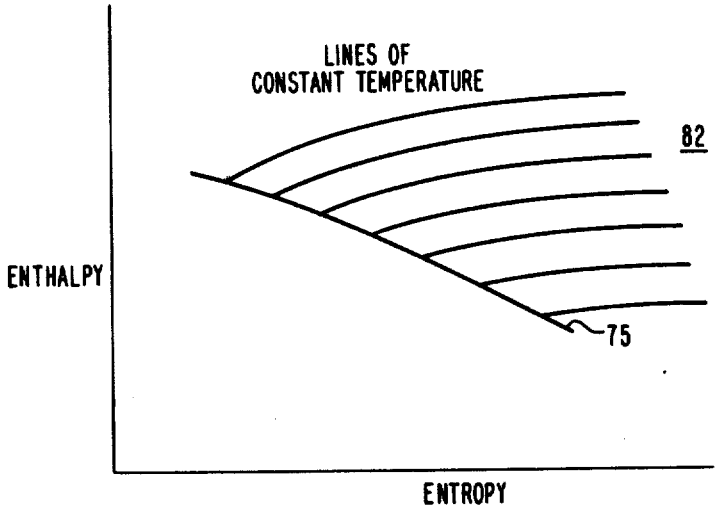
Figure 3C:
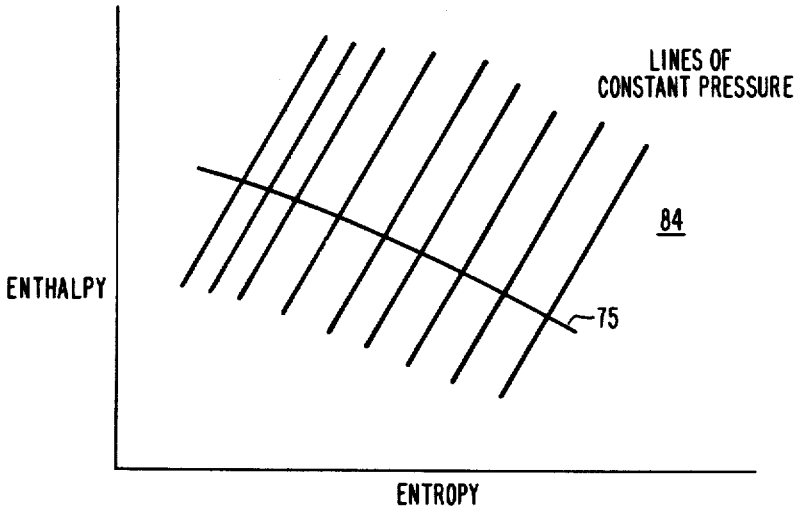
Figure 3D:
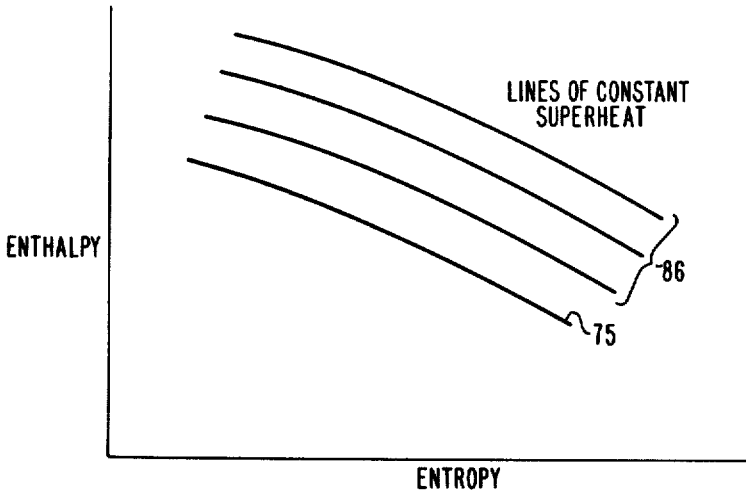
Figure 3E:
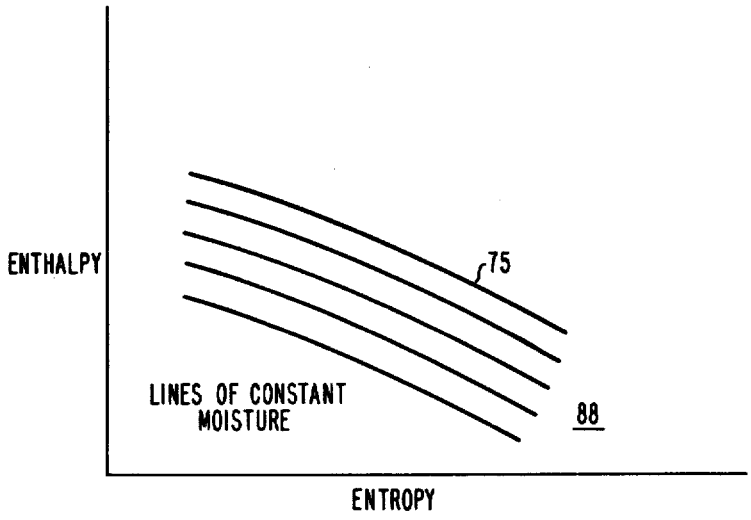

The Mollier diagram includes additional parameters associated with the steam and these are illustrated separately in FIGS. 3B–3E. FIG. 3B illustrates lines of constant temperature 82, relative to the saturation line 75, FIG. 3C illustrates lines of constant pressure 84, FIG. 3D illustrates lines of constant superheat 86 and FIG. 3E illustrates lines of constant moisture 88, all of which are well known to those skilled in the art.

Figure 4:
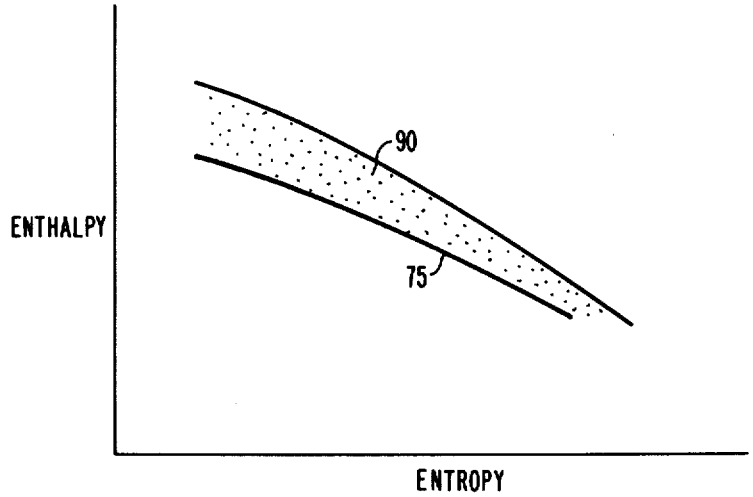
FIG. 4 is a plot, as in FIGS. 3A–3E illustrating a salt solution zone.

During operation of the steam turbine, moderately water soluble salts such as sodium chloride are stable only in a narrow band near the liquid-vapor saturation line 75. Thus in FIG. 4 the shaded zone 90 is the only region where concentrated salt solutions are stable and thus the corrosive effects of sodium chloride are localized at about the L-1 stage of the low pressure turbine. Above the shaded zone 90 pure dry sodium chloride is stable in superheated steam and does not have corrosive effects, and below zone 90, in the wet region, salt contamination is so dilute as to be without corrosive significance.

Figure 5A:
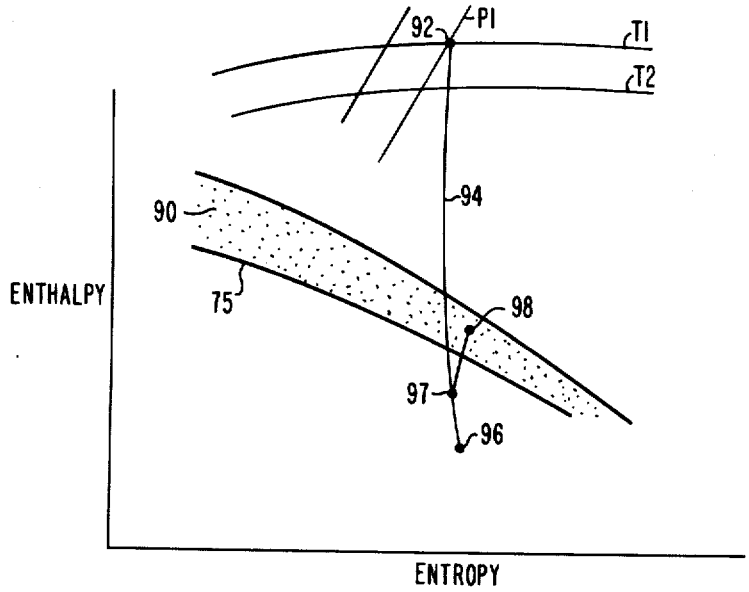
FIGS. 5A and 5B are plots as in FIGS. 3A–3E illustrating operation of the low pressure stage of the steam turbine and modified operation in accordance with the present invention.

The Mollier diagram of FIG. 5A represents steam expansion as it occurs from the inlet of the IP turbine to the L-1R blade of the LP turbine for a particular load. Point 92 represents the input steam at a pressure of P1 and at a temperature of T1. The steam expansion line 94 crosses the salt sodium solution zone 90 and saturation line 75 and points 96, 97 and 98 respectively represent the steam conditions existing at the hub, mean diameter and tip of the rotating blade L-1R. It is seen in FIG. 5A that a portion of the blade will be located in the salt solution zone 90 whereby corrosive salt solutions will be deposited on the blade. In accordance with the present invention the operating conditions of the turbine are shifted so as to avoid this operation. One method by which may be accomplished is illustrated in the Mollier diagram of FIG. 5B.

Figure 5B:
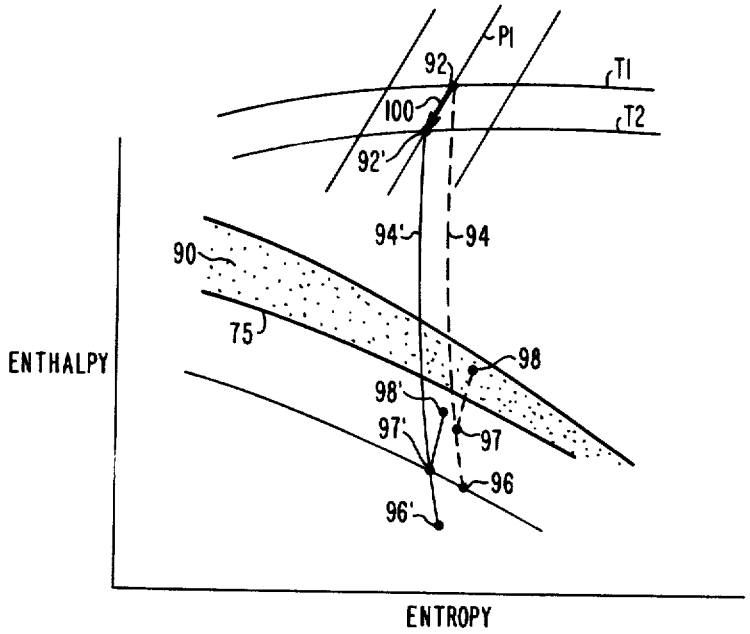

For comparison, expansion from point 92 to points 96, 97 and 98 in the L-1 stage is shown dotted in FIG. 5B. Instead of expansion along line 94, however, in the present invention the steam conditions are varied prior to its admittance into the LP turbine. For example by adjusting operation of the reheater 30 (FIG. 1) the steam expansion line may be shifted to that illustrated at 94'. Since the reheat temperature cannot be increased above its nominal maximum T1, it is decreased from temperature T1 to temperature T2 at a constant pressure P1 along the line 100 to input point 92'. The expansion, as represented by steam expansion line 94' thus brings the blade hub, mean diameter and tip points 96', 97' and 98' well into the moisture zone below saturation line 75 and out of the salt saturation zone 90. Similar results may be obtained by controlling the steam pressure (indicative of the load of the unit) so as to relatively shift the salt solution zone off of a rotating blade row and onto a stationary blade row where corrosion associated cracking is not likely to occur.

In order to control this positioning of the salt solution zone, operating parameters such as the reheat temperature, or the steam generator pressure (and hence the power load percentage of the unit) may be varied. In addition, an indication is obtained of the location of the salt solution zone within the turbine stages. To obtain this latter indication an arrangement such as is illustrated in FIG. 6 may be utilized.

Figure 6:
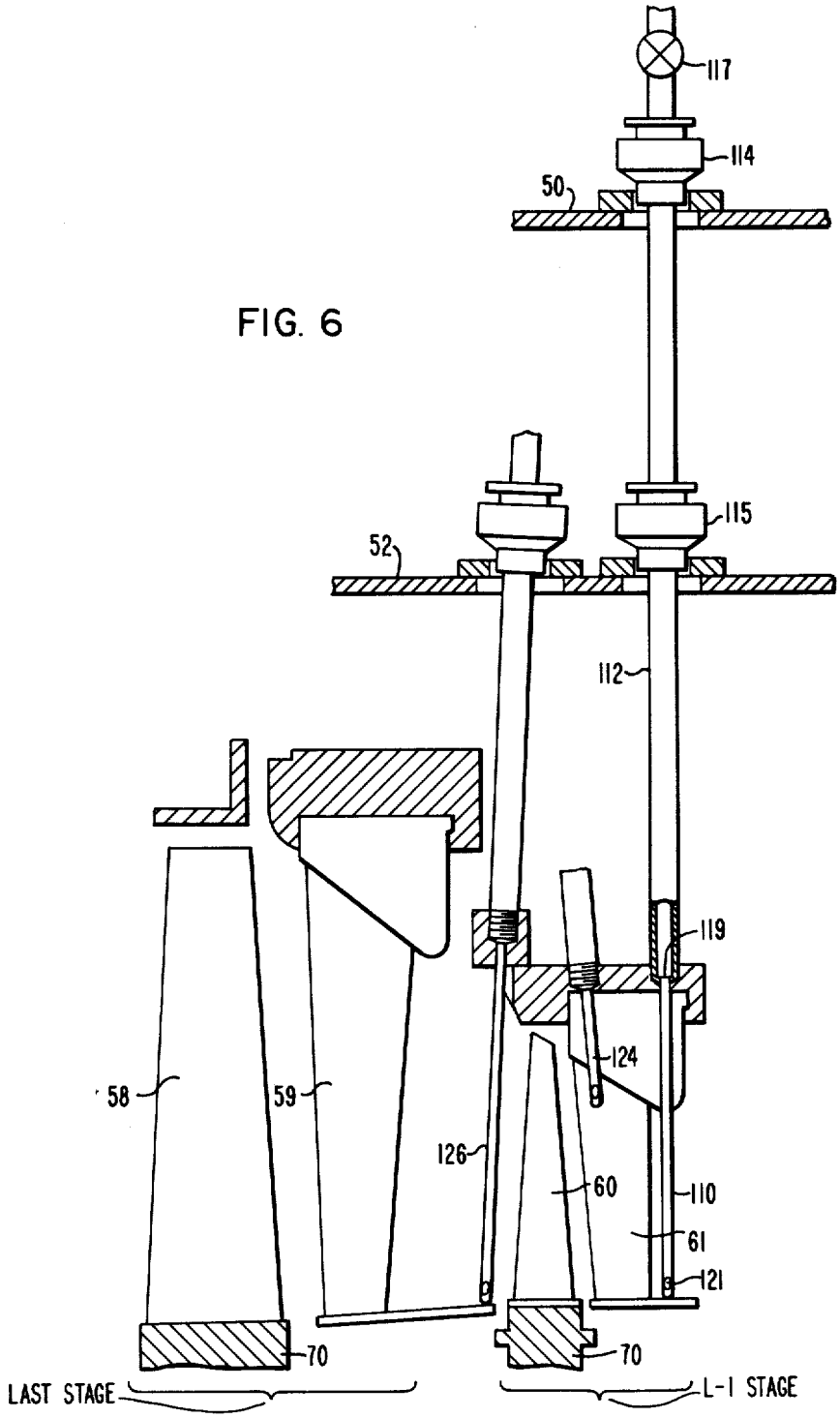
FIG. 6 is a sectional view through a portion of the turbine illustrating the placement of certain measuring probes.

FIG. 6 illustrates a portion of the low pressure turbine illustrated in FIG. 2 but additionally includes a probe 110 positioned within a probe guide 112 inserted through outer cylinder 50 and an inner cylinder 52 and held in place by means of respective fixtures 114 and 115. Probe 110 is inserted through a valving arrangement 117 outside of the turbine and the insertion thereof is limited by shoulder 119 of the probe 110 so as to position a measuring cell such as conductivity cell 121 in the steam flow path. The conductivity cell and probe arrangement may be as described in the aforementioned copending application.

Probe 110 (and accordingly conductivity cell 121) is positioned in the general vicinity of the salt solution zone under normal operating conditions, this being, in the example illustrated, at the L-1 stage, and more particularly at the beginning thereof.

For reference purposes, other probe and conductivity cell arrangements 124 and 126 may be provided in the middle and at the end of the L-1 stage respectively. As an alternative to the elongated probe arrangements, relatively small, flat conductivity cells may be positioned at various points in the turbine stage, such as on the cylinder blades, with electrical leads being connected to equipment outside of the turbine.

As a salt solution zone moves relatively past the conductivity cell 121 an output signal therefrom will be provided in proportion to the conductance of the solution deposited on the cell. In addition, and as indicated in the aforementioned copending application, a thermocouple may also be included so as to give a temperature reading at the conductivity cell location.

Figure 7:
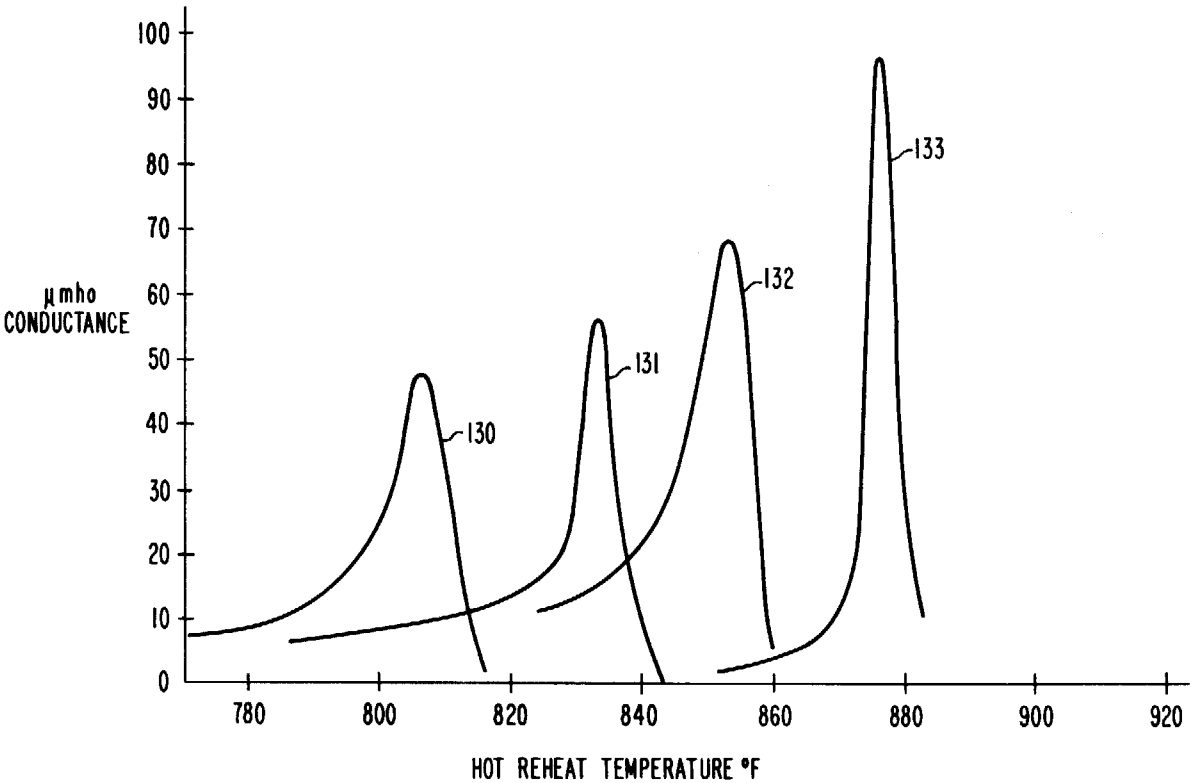
FIG. 7 illustrates plots of the output of the sensor located in one of the probes of FIG. 6 as a function of reheat temperature and load.

The curves of FIG. 7 illustrate the relationship between the output signal of the conductivity cell 121 in micromhos with respect to hot reheat temperature in degrees F., under different load conditions.

FIG. 7 illustrates the results of an actual test during which the reheat temperature was varied for each load condition. Curve 130 shows the conductance value with operation at 38% load. Initially, the reheat temperature was high enough (at about 820° F.) to maintain the probe in the superheated region and above the salt solution zone. In this dry condition no output signal from the conductivity cell is produced. As the reheat temperature is reduced the conductivity cell responds to the formation of solutions of concentrated salts and an increase in the conductance level occurs within a relatively narrow range of temperature change. Curve 130 illustrates the conductance level peaking at approximately 807° F. and as the reheat temperature is further reduced the conductivity cell output levels off at a substantially constant residual value typical of the conductance of water which may be mixed with ammonia or amines from the water treatment process.

Increasing the temperature past the peak of curve 130 has the effect of moving the salt solution zone to the left of the probe 110 illustrated in FIG. 6, whereas reducing the temperature has the effect of moving the salt solution zone to the right of the probe. Thus by cycling (periodically increasing and decreasing) the reheat temperature corrosive salt depositions may be washed away from a rotating blade such as L-1R and deposited upon a stationary cylinder blade. A peak reading from a conductivity cell may indicate that no action need be taken since the salt solution zone would be directly on the probe itself.

Curves 131, 132 and 133 of FIG. 7 show the relationship between conductivity cell output and reheat temperature under 54%, 65% and 77% load conditions, respectively. In a manner similar to curve 130, each of the curves 131 to 133 include a peak value which decreases rapidly toward zero as the reheat temperature is increased, and decrease to a residual value with a reduction of reheat temperature. As was the case with respect to curve 130, operation to the right of a peak of curves 131 to 133 represents operation in the dry superheated region whereas operation to the left of the peaks represents the wet moist region.

Figure 8:
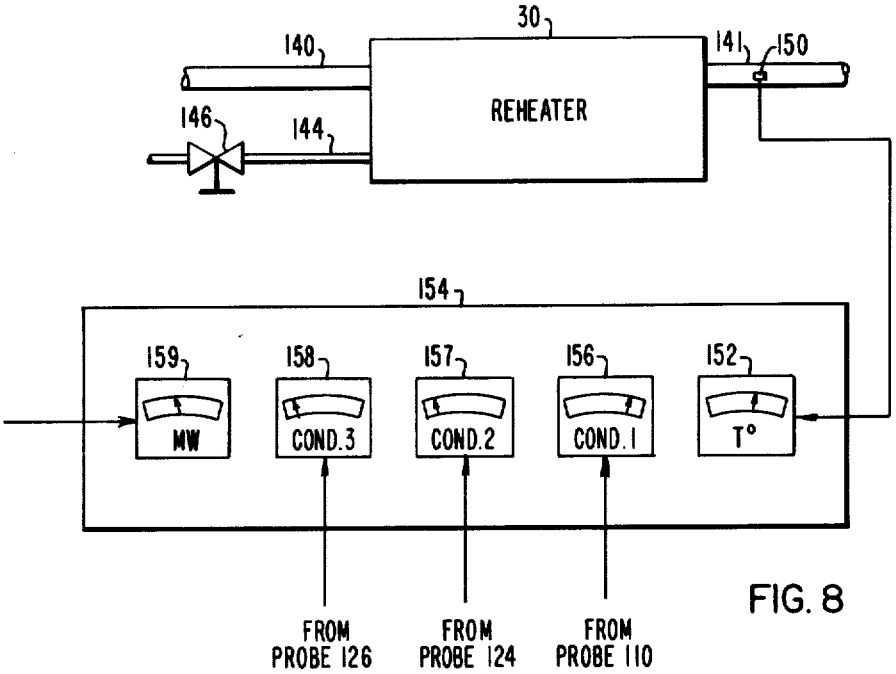
FIG. 8 is a simplified block diagram of a reheater control arrangement.

One way of accomplishing the reheat cycling to move the salt solution zone to a stationary blade row rather than a rotating blade row is illustrated in FIG. 8. Steam enters the reheater 30 from the HP turbine via line 140 and exits from the reheater via line 141 where it is provided to the IP turbine valving 34 (FIG. 1). The reheater system is of standard design depending upon the turbine system. By way of example, in one design the steam is heated by means of fuel-fed flames, and in another design by means of superheated steam. In FIG. 8, therefore, line 144 represents the fuel or steam line for reheating purposes and valve 146 is operative to control the amount of fuel or steam provided so as to control the reheat temperature. A thermocouple 150 is positioned so as to obtain the temperature of exiting steam and provide an indication thereof to a temperature readout 152 of display panel 154. Display panel 154 may also include readouts 156 through 158 for displaying the conductance reading of the conductivity cells carried by the probes illustrated in FIG. 6.

Taking readout 156 as exemplary, in response to the output reading thereof, the valve 146 may be varied so as to change the reheat temperature thus causing a movement of the salt solution zone. If desired, the reheat temperature may be cycled so as to effectively wash the blades with wet steam to remove any deposited salt solutions. During these operations it is desirable to have an indication of the load and accordingly a readout 159 is provided to give a megawatt reading.

Figure 9:
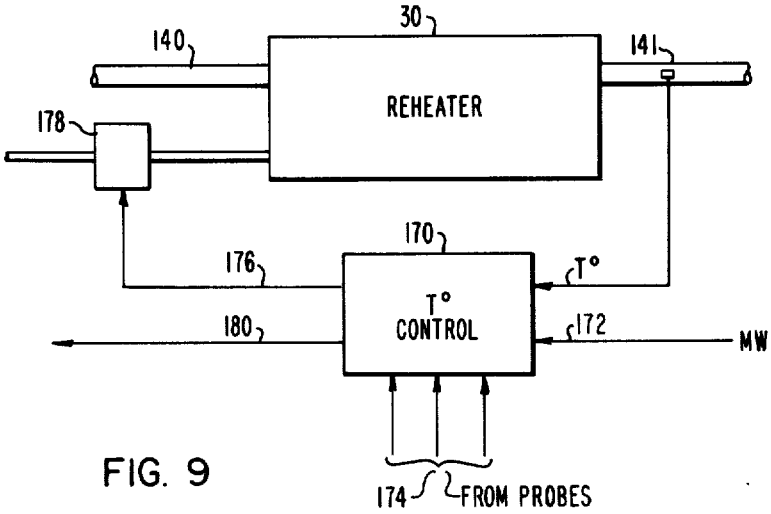
FIG. 9 is a simplified block diagram of an alternate reheater control arrangement.

As an alternative, and as illustrated in FIG. 9, the movement of the salt solution zone by varying the reheater temperature may be accomplished automatically with the provision of a temperature control circuit 170 which receives a temperature input signal from thermocouple 150, a megawatt input signal on line 172 indicative of load, and the probe input signals on lines 174. Temperature control circuit 170 is operable to make a comparison of the probe signals relative to a schedule of predetermined signal strengths as a function of operating conditions and on the basis of this comparison generate a control signal on line 176 to control operation of valve 178 governing the input of fuel or steam to the reheater. Additionally, a control signal may be generated on line 180 for changing the load to accomplish the movement of the salt solution zone. This latter signal on line 80 may be utilized to control the fuel feed rate for the steam boiler 26 of FIG. 1.

What we claim is:

1. A method of reducing the effects of corrosive salt solutions, on rotating blades of a low pressure turbine of a turbine system including a steam generator, a reheater in the steam flow path prior to said low pressure turbine, said solutions occurring in a relatively narrow salt solution zone, comprising the steps of:

(A) placing a measurement device directly in the steam flow path within said low pressure turbine at a location so as to provide an indication of said corrosive salt solutions;

(B) obtaining an indication of operating load;

(C) shifting an operating parameter of said turbine system based upon said indications so as to shift said salt solution zone.

2. A method as in claim 1 wherein:

(A) the reheater is controlled so as to vary its output temperature.

3. A method as in claim 1 wherein:

(A) the steam pressure provided by said steam generator is varied.

4. A method as in claim 1 wherein:

(A) said operating parameter is cycled so as to cause a cycling of said salt solution zone and a consequent washing of selected turbine blades.

5. Apparatus for reducing the effects of corrosive salt solutions on rotating blades of a low pressure turbine of a turbine system including a steam generator, a reheater in the steam flow path prior to said low pressure turbine, said solutions occurring in a relatively narrow salt solution zone, comprising:

(A) at least one conductivity sensor placed directly in the steam flow path within said low pressure turbine;

(B) said conductivity sensor being operable to provide an output signal proportional to the conductance of said salt solution zone when immersed therein;

(C) means for providing an indication of operating load;

(D) means for varying an operating parameter of said system in response to said output signal and as a function of said operating load to vary the steam expansion within said low pressure turbine so as to shift said salt solution zone.

6. Apparatus according to claim 5 wherein:

(A) said means for varying, varies the output temperature of said reheater.

7. Apparatus according to claim 6 wherein:

(A) said means for varying, cycles said output temperature.

8. Apparatus according to claim 5 wherein:

(A) said means for varying varies the pressure of the steam provided by said steam generator.

9. Apparatus according to claim 5 which includes:

(A) at least three conductivity sensors positioned respectively at the beginning, in the middle, and at the end of a blade stage.

10. Apparatus according to claim 9 wherein:

(A) said blade stage is the next-to-last blade stage of said low pressure turbine.

11. In combination:

(a) a steam turbine;

(b) a conductance cell positioned within said steam turbine, in the steam flow path thereof and operable to provide an output signal indicative of impurities in said steam; and (c) means responsive to said output signal to control the operation of said steam turbine to reduce said impurities.

12. Apparatus according to claim 11 wherein:

(a) said turbine is a low pressure turbine having a plurality of blade stages, each stage including a rotating blade row and a stationary blade row;

(b) said conductance cell being positioned at the entrance of one of said blade stages.

13. Apparatus according to claim 12 which includes:

(a) a second conductance cell positioned at the exit of said one blade stage.

14. Apparatus according to claim 13 which includes:

(a) a third conductance cell positioned between said entrance and said exit of said one blade stage.

15. Apparatus according to claim 12 wherein:

(a) said one blade stage is the next-to-last blade stage.

* * * * *